United States Patent [19]

Krieger

[11] 4,161,136

[45] Jul. 17, 1979

[54] HYDRAULIC JACK CONTROL DEVICE

[75] Inventor: Karl Krieger, Wuppertal, Fed. Rep. of Germany

[73] Assignee: Maschinenfabrik GmbH & Co., Wuppertal, Fed. Rep. of Germany

[21] Appl. No.: 850,560

[22] Filed: Nov. 11, 1977

[30] Foreign Application Priority Data

| | | | |
|---|---|---|---|
| Nov. 13, 1976 | [DE] | Fed. Rep. of Germany | 2651913 |
| Jan. 17, 1977 | [DE] | Fed. Rep. of Germany | 2701668 |
| Mar. 11, 1977 | [DE] | Fed. Rep. of Germany | 2710649 |

[51] Int. Cl.[2] ..... F15B 13/042

[52] U.S. Cl. ..... 91/461; 91/420; 91/447; 91/465; 137/244; 137/557; 137/596.14

[58] Field of Search ..... 137/244, 557, 596.14, 137/596.16; 91/170 MP, 420, 447, 461, 465

[56] References Cited

U.S. PATENT DOCUMENTS

| | | | |
|---|---|---|---|
| 3,598,148 | 10/1971 | Kroffke | 137/596.16 |
| 3,989,066 | 11/1976 | Sturman et al. | 137/624.2 |

*Primary Examiner*—Gerald A. Michalsky

*Attorney, Agent, or Firm*—Berman, Aisenberg & Platt

[57] ABSTRACT

A control unit for controlling the supply of fluid to a hydraulic jack, the control device including a main valve having a valve member normally held closed by pressure in a pressure chamber, the pressure chamber being fed with fluid through a bore in a valve member of the main valve. In one embodiment, a valve spindle slides in the bore to stop it being blocked. In another embodiment, designed to control a double-acting jack, the main valve is associated with a second similar main valve the pressure chamber of which is fed from the first main valve instead of through a bore in its valve member.

10 Claims, 3 Drawing Figures

HYDRAULIC JACK CONTROL DEVICE

This invention relates to a control device for controlling the flow of hydraulic fluid to and from an hydraulic jack such as a pit prop used to support a mine roof or a ram which is used to advance a roof-support towards a coal face.

A control device has been proposed which comprises a single valve having a housing provided with an inlet passage for connection to a pressure supply line, an outlet passage for connection to a fluid reservoir, and a jack-supply passage for connection to a jack cylinder. A valve member is movable in the housing between a first position in which the jack-supply passage is connected to the outlet passage to allow the jack to retract, and a second position in which the jack-supply passage is connected instead to the inlet passage so that pressurised fluid can flow to the jack cylinder to extend the jack. The pressure usually supplied to the valve is very high, so that in the proposed valve provision is made to permit the valve member to move from its first position to its second position without the need to apply a very high manual force on an operating member for moving the valve member against the force of the hydraulic fluid which acts on one side of the valve member to hold it in its first position. This is achieved by providing the valve member with a portion that serves as a piston having first and second piston faces disposed on opposite sides thereof. The second face of the piston portion is subjected directly to pressure existing in the inlet passage to urge the valve member towards its second position, and a passage extends through the piston portion to connect the inlet passage to a pressure chamber defined between the valve housing and the first face of the piston portion. The first face of the piston portion which bounds the pressure chamber has a surface area larger than the second face whereby to produce a resultant force urging the valve member (when fluid pressure is the same on both faces) to its first position in which the jack can contract when a non-return valve on the jack is opened. However, a bleed valve is provided for bleeding fluid from the pressure chamber so that the pressure in the pressure chamber acting on the first face of the piston portion drops and the valve member is moved to its second operating position by the force acting on the second face of the piston portion so that the jack is extended. The passage through the piston portion for supply of fluid to the pressure chamber is very narrow so that fluid can leave the pressure chamber via the bleed valve more easily than it can enter the pressure chamber via the passage in the piston portion. The bleed valve can be opened by an operating member which needs little force to move it.

The control device described above is designed to control the supply of fluid to one end of a jack cylinder only.

With a view to providing a control device which can be used to supply fluid to both ends of a double-acting hydraulic jack for extending and retracting the same, this invention (according to a first aspect thereof) is directed to a control device comprising two valves, each valve comprising a housing and a valve member movable in the housing, each valve housing having an inlet passage for connection to a pressurised fluid supply line, an outlet passage for connection to a fluid reservoir, and a jack-supply passage, the jack-supply passages being for connection one to each end of a jack cylinder of said jack, each valve member being movable in its said housing between a first position in which its jack-supply passage is connected to its outlet passage and a second position in which its jack-supply passage is connected to its inlet passage, each valve member having a piston portion, each piston portion having first and second faces disposed one on each side thereof, a pressure chamber being defined between the first face of each piston portion and its corresponding housing, each said first face of each valve member piston portion being subjected to fluid pressure in its corresponding pressure chamber to urge the valve member towards its first position, and each said second face being subjected to the pressure in the inlet passage to urge the valve member towards its second position, each said first face having an effective surface area larger than the effective surface area of its corresponding second face whereby to produce a resultant force urging each valve member towards its first position when pressures on the first and second face of each piston portion are equal, each pressure chamber having a bleed valve for bleeding fluid therefrom, each bleed valve having an operating member operable to open the bleed valve to relieve the pressure in its associated pressure chamber and allow its associated valve member to be moved to its second position by fluid pressure exerted on its said second face, the valve member of a first of the valves having an passage extending through its piston portion and placing its associated pressure chamber in communication with its inlet passage, the control unit further comprising a valve-connecting passage for placing the jack-supply passage of the first valve in communication with the pressure chamber of the second valve.

The advantages of a control device according to the first aspect of the invention are described later with reference to the drawings.

Referring again to the previously proposed control valve described above, and also to the said first valve of a control device according to the first aspect of the invention, one problem is that the passage in the piston portion of the valve member may tend to be blocked by dirt in the pressure fluid.

With a view to avoiding this problem this invention, according to a second aspect thereof, provides a control device for controlling the flow of hydraulic fluid to and from a jack to extend the jack and to allow the jack to retract, the device comprising a valve having a housing and a valve member movable in the housing, the housing having an inlet passage for connection to a pressurised supply line, an outlet passage for connection to a fluid reservoir, and a jack-supply passage for connection to a jack cylinder, the valve member being movable in the housing between a first position in which the jack-supply passage is connected to the outlet passage and a second position in which the jack-supply passage is connected to the inlet passage, the valve member having a piston portion with first and second piston faces disposed one on each side thereof, a pressure chamber being defined between the housing and the first face of the piston portion, the first face being subjected to fluid pressure in the pressure chamber to urge the valve member towards its first position, a passage including a bore extending through the piston portion and placing the pressure chamber in communication with the inlet passage, the second face of the piston portion being subjected directly to pressure existing in the inlet passage to urge the valve member towards its second position, the first face having an effective surface area larger than the effective surface area of the second face whereby to produce a resultant force urging the valve member towards its first position when fluid pressure is the same on both piston faces, a bleed valve being provided for bleeding fluid from the pressure chamber to relieve the pressure therein to allow the valve member to be moved to its second position by fluid pressure exerted on its second face, a valve spindle being disposed with one end region thereof in the bore and slidable therein with a radial (i.e. lateral) clearance, and its other end abutting the valve housing, the arrangement being such that during movement of the valve member from its first position to its second position the spindle slides further into the bore so as to eject from the bore the majority of fluid therein, which ejected fluid (which may entrain dirt particles) flows towards the jack-supply passage.

Several embodiments of a control device according to the invention will now be described by way of example with reference to the accompanying drawings, in which.

Figure 1:
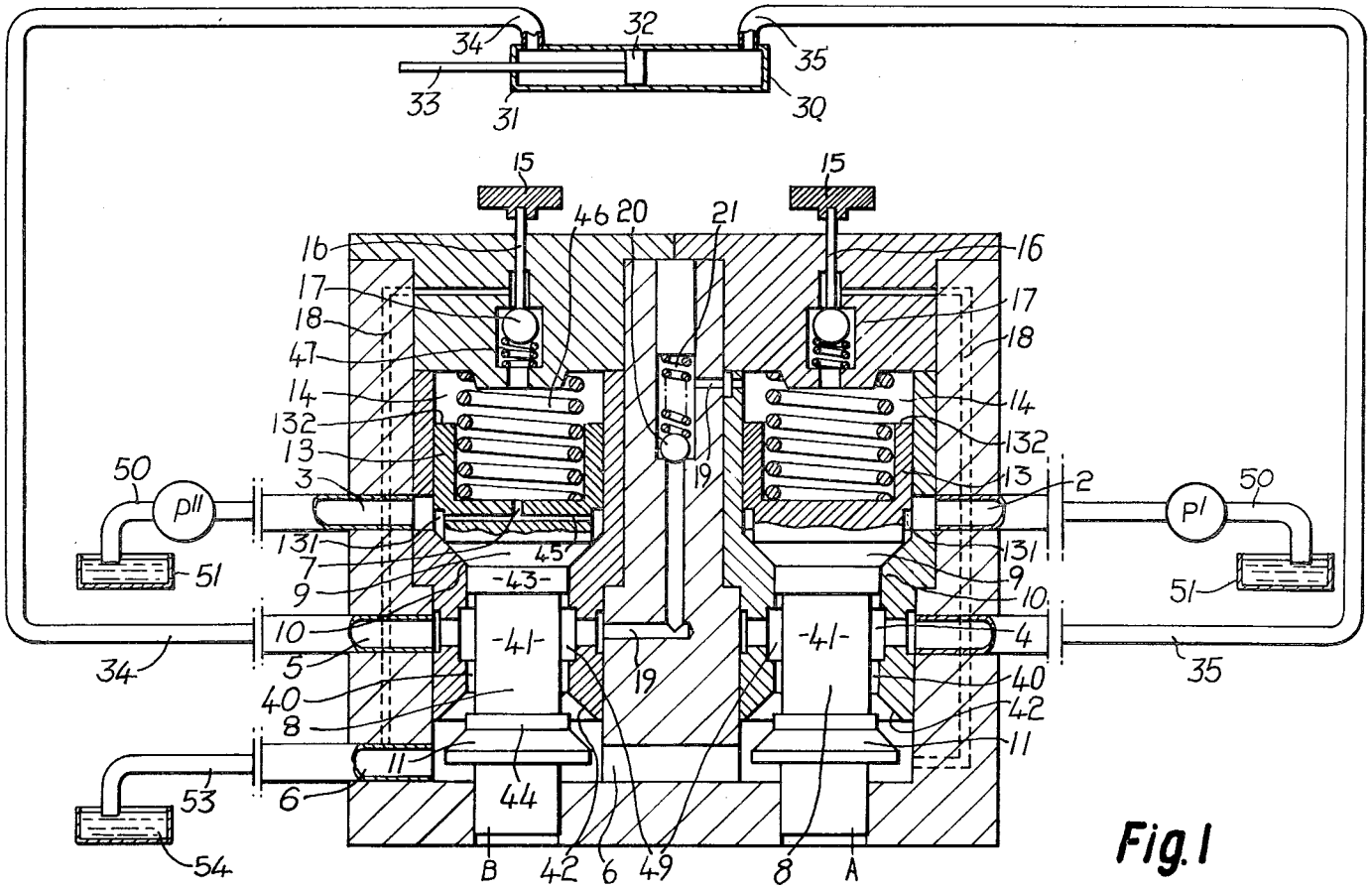
FIG. 1 is a diagrammatic view showing in cross-section a control device controlling fluid flow to both ends of a double-acting jack, the jack being shown on a very much smaller scale than the control device.

FIG. 1 shows diagrammatically a control device for controlling the flow of fluid to and from a jack 30. The jack 30 comprises a cylinder 31, a piston 32 slidable within the cylinder 31, and a piston rod 33 connected to the piston for movement by the piston. The jack 30 is double-acting and jack supply lines 34 and 35 are connected one at each end of the cylinder 31. In order to extend the jack 30, fluid under pressure must be supplied to the supply line 35 from a pump P' to force the piston 32 to move to the left as viewed in FIG. 1 and the supply line 34 must be connected to a fluid reservoir 54 to permit fluid to be expelled from the left hand end of the cylinder by the advancing piston. Conversely, by connecting the line 34 to a source of pressurised fluid delivered by a pump P'' and connecting the line 35 to the reservoir 54, the jack 30 can be made to retract.

The control device for effecting the fluid connections described above comprises two valves A and B disposed side by side. The valves each comprise a respective valve member 8 slidable in a flat housing 1 which is common to both valves A and B. The valve B will be described first. It has an inlet passage 3 to which a supply line 50 incorporating the pump P'' is connected, the inlet end of line 50 extending into a reservoir 51. A jack-supply passage 5 of the valve is connected to the jack-supply line 34 mentioned above, the passage 5 serving to supply fluid to or receive fluid from the jack 30 by way of line 34 according to whether the jack is extending or retracting. The valve B also includes an outlet passage 6 which is connected by a line 53 to the reservoir 54 mentioned above. The valve member 8 of valve B is axially slidable in a stepped bore 40, there being a clearance space between a lower narrower portion 41 of valve member 8 and a lower portion of the bore 40. This clearance space includes an annular chamber 49 into which the passage 5 opens. The lower portion of bore 40 has an upper frusto-conical valve seat 10 and a similar lower valve seat 42, and the valve member 8 has seat-engaging portions 9 and 11 which serve to seat against respective seats 10 and 42.

A collar 43 is disposed between the seat-engaging portion 9 and the narrower portion 41 of the valve member 8, the collar being of such a diameter as to be a generally fluid-tight sliding fit within the lower portion of the bore 40. A similar collar 44 is disposed between the seat-engaging portion 11 and the narrower portion 41 of valve member 8, the length of the collar 44 (measured axially of the valve member) being less than the length of the collar 43.

An upper portion 13 of the valve member 8 is constructed as a piston which is disposed in an upper portion of the bore 40 which is of larger diameter than the lower portion of the bore 40. The piston 13 has upper and lower faces both of which (as will be described below) are subjected to the pressure of fluid supplied to the inlet passage 3. The lower face of piston portion 13 is comprised by an annular shoulder 131 which has a relatively small surface area. This shoulder 131 is disposed adjacent the inlet passage 3 and is subjected directly to the fluid pressure in the high pressure supply line 50. The upper face 132 of the piston portion 13 has a much larger surface area approximately equal to $\pi r^2$, where the radius r is equal to half the full diameter of the piston portion 13. The upper piston face 132 is subjected to the pressure of hydraulic fluid in a pressure chamber 14 defined between the upper wider portion of bore 40 and the upper face 132. The piston portion 13 has a passage extending through it for the flow of fluid from the inlet passage 3 to the pressure chamber 14, such passage comprising a transverse bore 45 communicating with a narrow axial bore or constriction 7.

A compression spring 46 is disposed in the pressure chamber 14 and acts between the housing 1 and the upper face of the piston 13, the lower portion of the spring being disposed in a recess in the piston.

The fluid in the pressure chamber 14 can be bleed to the outlet passage 6 (and thus to the reservoir 54) via a bleed passage 18 which extends through the body of the housing 1. The inlet of the passage 18 is normally closed by a ball 17 of the bleed valve, such ball 17 being urged to close the passage inlet by way of a small compression spring 47 acting between the ball 17 and the housing 1. The ball 17 can be forced downwardly to open the passage 18 by means of a rod 16 which extends through the housing and can be depressed by a push button member 15.

The valve A is very similar to valve B described above and parts of valve A corresponding to similar parts of valve B are indicated by the same reference numerals as those used for valve B, except that the jack-supply passage of valve A is referenced 4, and its inlet passage is referenced 2. Because valve A is similar to valve B it does not require detailed description. However, an important difference between the valves is that the valve A lacks a passage (shown at 45 and 7 on valve B) placing its chamber 14 in communication with its pressure supply line 50.

The two valves A and B communicate with one another via a valve-connecting passage 19 in a portion of the housing disposed between the valves. This passage 19 connects the annular chamber 49 of valve B (and thus jack supply line 34) with the pressure chamber 14 of valve A. The passage 19 contains a non-return ball valve comprising a ball 20 biased by a compression spring 21 against a valve seat to close passage 19. The outlet passage 6 of valve A communicates with reservoir 54 by way of the passage 6 of valve B.

Each valve member 8 has two operating positions. In the first position (illustrated) of each valve member, its upper seat-engaging surface 9 engages seat 10 whilst its lower seat-engaging surface 11 is spaced from seat 42. In this position of each valve member 8, the jack supply passages 4 and 5 of the valves are connected to the respective outlet passages 6 and thus to reservoir 54, and such passages 4,5 and 6 are isolated from the inlet passages 2 and 3. In the second position (not shown) of each valve member, its upper seat-engaging surface 9 is spaced above seat 10 whilst its lower seat-engaging surface 11 engages seat 42. In this position of each valve member 8, the jack supply passages 4 and 5 are connected to respective ones of inlet passages 2 and 3 and such passages 2,3,4 and 5 are isolated from the outlet passages 6.

Operation of the control device will now be described:

With the valve members 8 of valves A and B in their first positions (illustrated), both pressure lines 50 are isolated from the jack supply lines 34 and 35 so that no pressure is applied to the jack 30. The valve member 8 of valve B is normally maintained in its illustrated position by two forces. The first force is that exerted by the spring 46, and the second force is that which the pressurised fluid in the pressure chamber 14 (fed via passage 45,7) exerts on the upper face of piston 13. These forces are opposed by a third force which the pressurised fluid exerts on the underface 131 of the piston. This third force is greater than the force exerted by the spring 46, but is less than the force exerted on the upper face of the piston. In order to move the valve member 8 of valve B from its first position, it is necessary to depress the button 15 of that valve to cause the rod 16 to force the ball 17 off its seat. The orifice which the ball 17 normally closes is very small relative to the size of the orifice which the seat-engaging face 9 of the valve member 8 normally closes, and for this reason the force needed to depress the button 15 is much less than the force which would be needed to open a valve member such as member 8 by means of a lever acting directly on the valve member as used in some known valves. When the ball 17 has been moved from its seat, fluid in pressure chamber 14 flows to the outlet passage 6 by way of passage 18 so that the pressure in chamber 14 is relieved. It will be appreciated that the bore 7 via which fluid enters the chamber 14 is very small, so that fluid cannot enter the chamber 14 quickly enough to maintain the pressure. The force which the pressurised fluid exerts on the underface 131 of the piston then overcomes spring 46 and moves the valve member 8 to its second position (not shown) in which the seat-engaging part 11 engages seat 42 and the seat-engaging part 9 is raised from its seat 10. This isolates the outlet passage 6 of valve B and connects the inlet passage 3 to the jack-supply passage 5 by way of the relatively large flow passage thus opened. As the valve member 8 of valve B moves to its raised position, the fluid supplied by pump P″ is supplied to the valve-connecting passage 19 and moves ball 20 off its seat to pressurise chamber 14 of valve A. This ensures that valve member 8 of valve A occupies its lower position shown in FIG. 1 as will be explained below. Thus, with the valve member 8 of valve B in its upper position and the valve member 8 of valve A in its lower position, jack supply line 34 is connected to the source P″ of pressurised fluid, whilst the jack supply line 35 is connected to the reservoir 54 via the chamber 49 of valve A and the outlets passages 6. The jack 30 is thus retracted.

When button 15 of valve B is released, the ball 17 of the bleed valve is returned to its seat by spring 47 and pressure again builds up in chamber 14 of valve B to return its valve member 8 to its illustrated position. During movement of the valve member 8 between its two seating positions, it passes through an intermediate position in which both collars 43 and 44 are disposed in the lower smaller diameter portion of bore 40 to isolate passages 2,3 and 4 from one another.

In order to now extend jack 30 once more, button 15 of valve A must be depressed. This relieves the pressure in chamber 14 of valve A and its valve member 8 is moved to its upper seating position. Thus, jack supply line 35 is connected to pump P′ via valve A, whilst supply line 34 is connected to reservoir 54 via valve B. The jack thus extends. When button 15 of valve A is released, since valve A has no passage like the passage 45,7 in valve B, pressure cannot again build up in pressure chamber 14 of valve A, so that valve A remains in its upper seating position. It will remain in this position until button 15 of valve B is depressed to pressurise chamber 14 of valve A via passage 19.

It will be understood that, by depressing button 15 of valve A for a short time, a force is applied to the jack 30 to extend it, and this force is maintained even when the button 15 is released. However, as soon as it is desired to relieve the force acting to extend jack 30, it is merely necessary to depress button 15 of valve B. In contrast to this, the force acting to retract jack 30 will be exerted only for as long as button 15 of valve B is held depressed.

The jack 30 may be a jack used both to urge a face conveyor towards a workface when extended, and used to draw a roof support frame up towards a work face by retracting. It could also be a roof-supporting prop biased by a continuous steady force to support a mine roof.

The pumps P′ and P″ can supply fluid at different pressures from one another. Thus pump P′ can supply fluid at a lower pressure than pump P″ if the jack is to exert a continuous low force on a face conveyor, or pump P′ can supply fluid at a higher pressure than pump P″ if the jack is to exert a continuous high force to support a mine roof.

One problem which can occur with the control device of FIG. 1 is that the axial bore 7 in the valve member 8 of valve A is likely to become blocked. The bore must be narrow to prevent pressure from being maintained in the pressure chamber 14 of valve B when the bleed valve is opened, and because of the dirty and dusty conditions prevailing in mines there is a high risk that the pressure fluid may contain small dirt particles which could block the narrow bore 7. The control device will not function if the bore 7 becomes blocked because the pressure in chamber 14 cannot build up to move the valve member 8 of valve B to its lower seating position when its bleed valve is closed by releasing its press button 15. A further problem is that the bore 7 tends to increase in size with use due to the high rate of wear caused by high pressure flow through the narrow bore.

Figure 2:
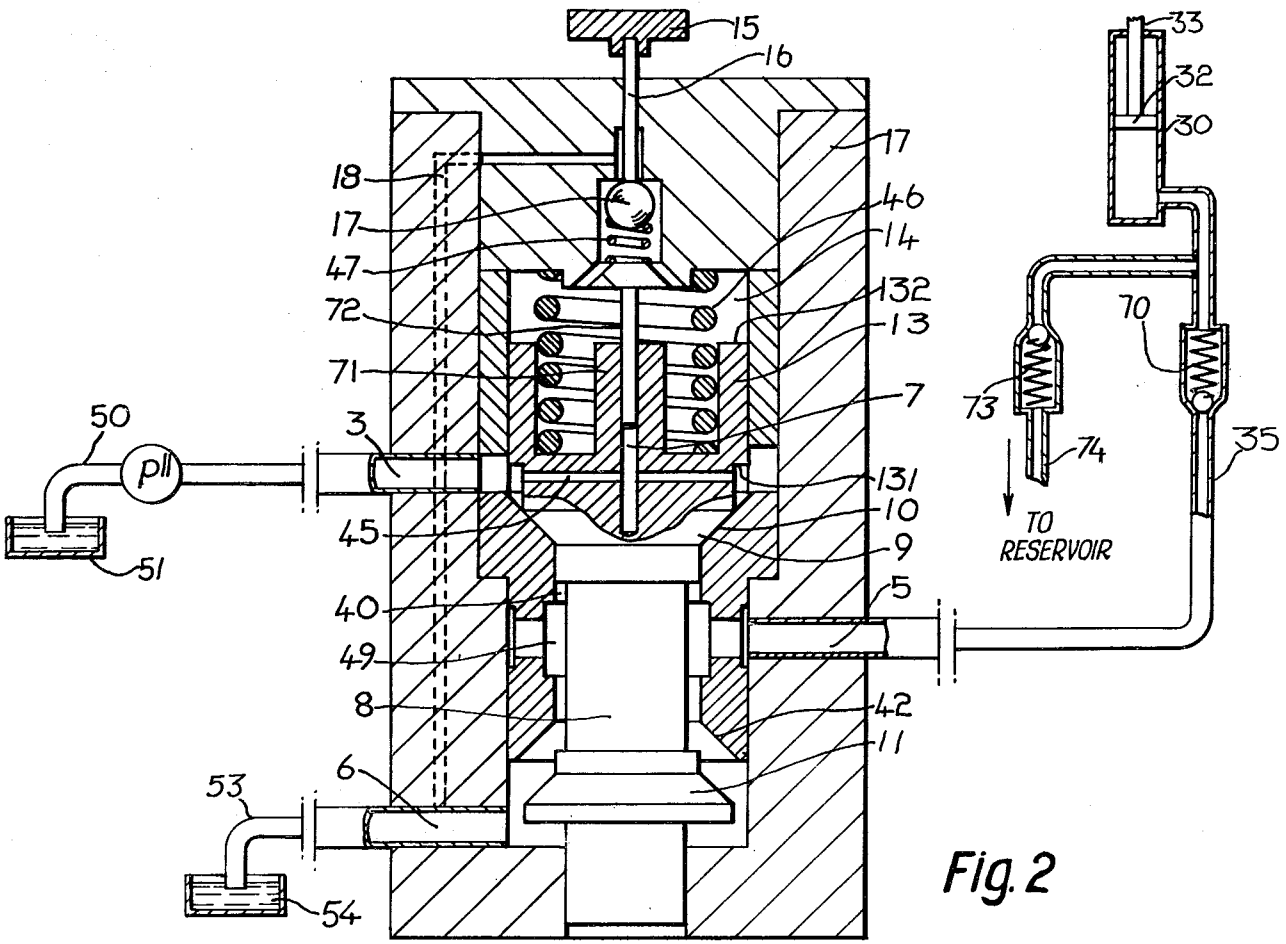
FIG. 2 is a view like FIG. 1, showing a modified control device for supplying fluid to one end only of a jack cylinder.

The valve shown in FIG. 2 is designed with a view to overcoming these problems. The valve is shown as a single valve used to control the flow of pressure to a one end only of a jack, but the valve could instead form one valve (the valve B) of a control unit like that of FIG. 1. Since the valve is like valve B in FIG. 1, only those features which are different in the valve of FIG. 2 will be described in detail. The upper face of the piston portion 13 of the valve member 8 is formed with a cylindrical upstanding projection 71 through which the axial bore 7 extends. The bore 7 extends deeper into the valve member 8 than was the case in FIG. 1, the bore 7 of FIG. 2 extending downwardly beyond the transverse bore 45. A valve spindle or needle 72 is axially slidable in the bore 7, one end of the needle 72 lying within the bore 7, and the other end of the needle extending beyond the bore and engaging the housing 1. The bore 7 of the valve of FIG. 2 is of larger diameter than the bore 7 of valve B of FIG. 1, and receives the needle 71 with a radial (i.e. lateral) clearance.

The valve operates in a manner similar to the valve B described above. Pressure in the pressure chamber 14 is relieved by operating the push button 15 of the bleed valve, and fluid cannot enter the chamber 14 via the radial clearance fast enough to maintain pressure in the chamber. Thus, the fluid pressure on the shoulder 131 overcomes the force of the spring 46 and raises the valve member 8 to its upper seating position. This causes the jack 30 to extend, fluid flowing from pump P″ to the jack cylinder via passage 3, chamber 49, passage 5, line 35, and a non-return valve 70. When the button 15 is released, the ball 17 returns to its seat to close off bleed passage 18 and pressure builds up once more in chamber 14 to move valve member 8 to its lower position. The jack 30 will extend only while the push button 15 is held depressed, and once the valve member 8 has returned to its illustrated position connecting the jack supply line 35 to the reservoir 54 the jack will remain extended because the valve 70 prevents fluid from leaving the cylinder 30. The valve 70 can be opened by a manually operable push button (not shown) to permit the jack to retract when required, and a pressure relief valve 73 in a line 74 connecting the cylinder 30 to reservoir 51 or 54 allows the jack to retract in response to an excessive pressure exerted on piston rod 33 by, for example, a mine roof.

As the valve member 8 moves to its upper position as a result of depressing push button 15, the needle 72 will penetrate into the lower part of bore 7 beneath passage 45.

Any dirt particles in the hydraulic fluid are unlikely to enter the narrow radial clearance between the needle 72 and bore 7, and will instead be pushed down towards the transverse bore 45 as the valve member 8 rises and the needle 72 penetrates further into bore 7 to expell the majority of fluid from the bore. Thus, the dirt particles will be carried away (whilst valve member 8 remains raised) through passage 45 and supply line 35 towards the jack 30. The jack is less sensitive to contamination by dirt particles than is the bore 7 of valve member 8.

The bore 7 of the valve of FIG. 2 is relatively easy to make because it is wider than the bore 7 of FIG. 1 and its precise diameter is not very critical because the further the needle penetrates into the bore 7, the less is the fluid flow rate through the bore 7. There is little wear of the needle or bore 7 by fluid flowing through the cylindrical gap between them.

The control device shown in FIG. 1 can give rise in certain circumstances to problems other than the problem of blocking of the bore 7. For example, when the device is used to control fluid flow to a roof-supporting prop of a roof-supporting frame, then if the roof yields above the prop the prop will extend further because it is supplied continuously with pressure from valve A. When the prop extends into the yielding roof, the frame may be damaged or displaced. A further disadvantage is that the continuous high pressure exerted on the prop may cause hose-pipes and seals to leak.

Figure 3:
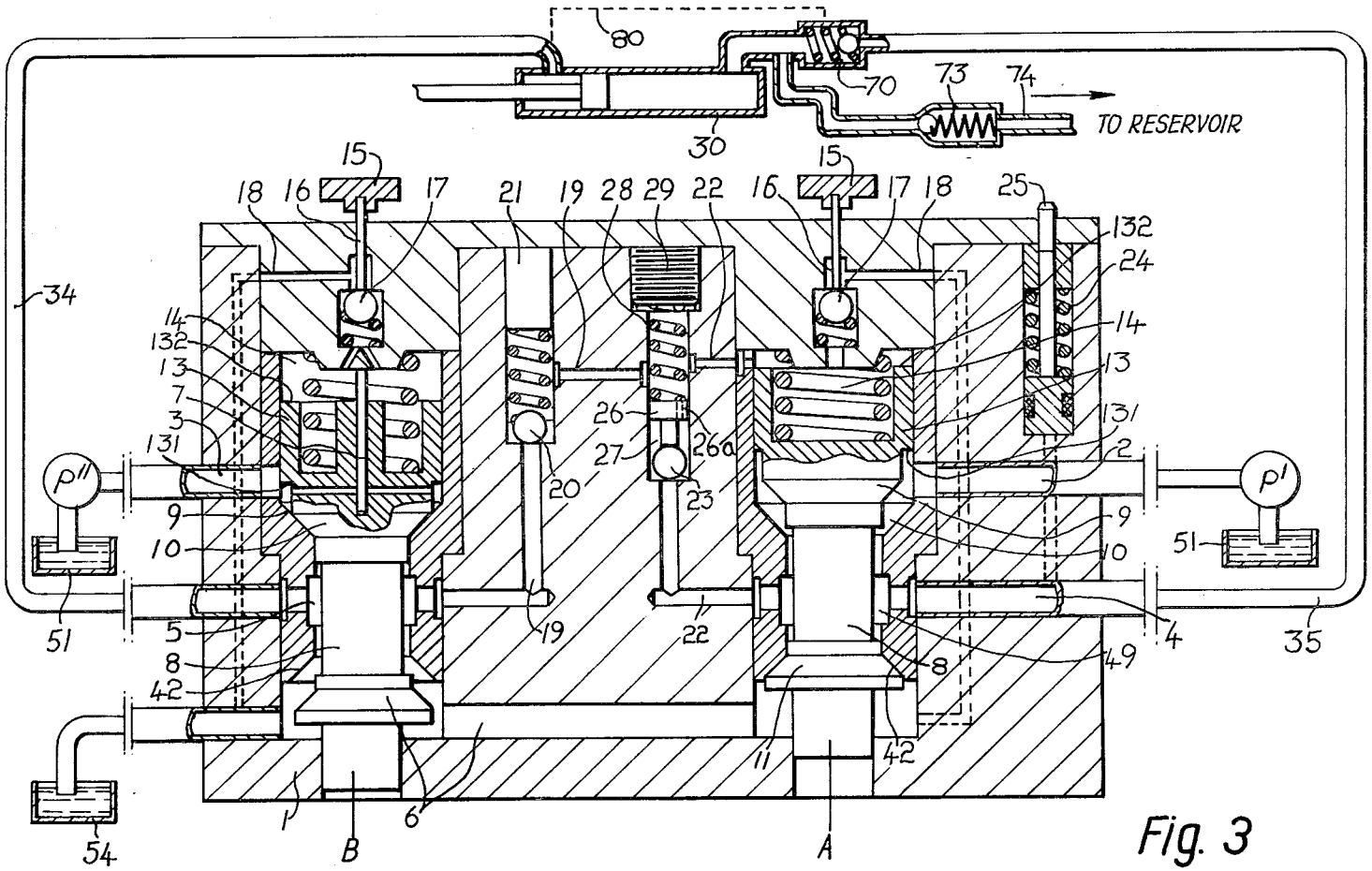
FIG. 3 shows a further embodiment of the invention which is similar to that shown in FIG. 1.

The control device shown in FIG. 3 overcomes the above problems. This control device is very similar to the device of FIG. 1, and therefore only those parts which differ from the device of FIG. 1 will be described. The valve B of the control device of FIG. 3 is a valve of the type shown in FIG. 2 to avoid the problem of blocking of bore 7 described above. The valve A of the device of FIG. 3 is similar to the valve A of FIG. 1, but its valve member 8 is shown in its upper seating position in FIG. 3. The most important difference between the control device of FIG. 1 and the control device of FIG. 3 is that the latter control device contains an additional pressure-communicating passage 22 extending between chamber 49 of valve A and the pressure chamber 14 of valve A. The passage 22 includes a bore 27 in which a ball 23 is disposed. A piston 26 having a fluid passage **26*a* extending through it is biased into contact with the ball 23 by a spring 28 which abuts a screw-threaded plug 29. By rotating the plug 29, the force which the spring 28 exerts on ball 23 via the piston 26** can be set to a desired level.

A pressure monitoring device 25 is mounted in a bore 24 in the housing 1, the device 25 giving an indication of the pressure in the jack-supply line 35, and also indicating the position of valve member 8 of valve A. The supply line 35 like the line 35 of FIG. 2 is connected to a pressure relief valve 73 and includes a non-return valve 70. However, the valve 70 of FIG. 3 can be opened not only manually by a push button (not shown), but also automatically by a device (not shown) when a high pressure is detected in jack supply line 34. The dotted line 80 represents a fluid line for conveying pressure from line 34 to valve 70 to open valve 70.

Operation of the device is similar to operation of the control device of FIG. 1, so a brief description only will be given. With the valve members 8 of the valves A and B in their positions illustrated, fluid will be flowing from pump P′, through valve A, through jack supply line 35 and valve 70 to the jack 30 to extend the jack. Fluid expelled from the jack by the advancing jack piston will flow through line 34 and valve B to the reservoir 54. During the time that the jack is extending, the pressure in the supply line 35 and thus in chamber 49 will be relatively low so long as the jack encounters little resistance. However, when the jack 30 encounters substantial resistance, for example as a result of the extending jack engaging a roof to be supported, then pressure starts to build up in jack supply line 35 and thus in chamber 49. The pressure in the chamber 49, which is proportional to the force exerted by jack 30, acts on the ball 23 in passage 22 to urge it upwardly. When the pressure is supply line 35 and chamber 49 builds up to a critical valve, the ball 23 will lift and pressurised fluid will flow past the ball 23, through the passage **26*a* in piston 26, and to the pressure chamber 14 of valve A to move its valve member 8 to its lower seating position. Now, since the force exerted on ball 23 by fluid in chamber 49 is opposed by the force of the spring 28, the pressure which must be reached in chamber 49 to cause the valve member 8 of valve A to move to its lower seating position can be set. Thus, the jack 30 will extend until it exerts a required set pressure (on a roof if the jack is a prop) and then valve member 8 of valve A will move to its lower position to interrupt the supply of pressurised fluid to jack 30 and to connect jack supply line 35 to the reservoir 54 by way of the valve passages 6. The non-return valve 70 will stop the jack 30 from retracting by preventing escape of fluid from the jack cylinder. Thus, unlike the case of the control device of FIG. 1, the pressure to extend the jack 30 is not maintained continuously. Therefore, if a roof supported by jack 30 should yield after the jack has been set, the jack will not then extend further upwards into the yielding roof to cause damage as described above. Naturally, this operation of extending the jack can be interrupted at any time merely by pressing push button 15 of valve B as was the case with the device of FIG. 1**.

The ball 23, piston 26, spring 28 and rotatable plug 29 together form an adjustable pressure limiting valve which limits the maximum pressure which is reached in jack-supply line 35 as the jack 30 is extended.

When it is desired to cause the jack 30 to retract, the button 15 of valve B is held depressed. Now, if the non-return valve 70 were merely manually operable, it would be necessary to hold button 15 of valve B depressed and at the same time to open valve 70 manually. However, this is avoided by constructing the valve 70 to be subject to pressure in line 34 as described above, so that when pressure builds up in line 34 to urge the jack to retract, such pressure will be fed via line 80 to a device for opening valve 70.

What is claimed is:

1. A control device for controlling the supply of fluid to a double-acting jack for extending and retracting the jack, the control device comprising first and second valves, each valve comprising a housing and a valve member movable in the housing, each valve housing having an inlet passage, an outlet passage, and a jack-supply passage, each valve member being movable in its said housing between a first position in which its jack-supply passage is connected to its outlet passage and a second position in which its jack-supply passage is connected to its inlet passage, each valve member having a piston portion, each piston portion having first and second faces disposed one on each side thereof, a pressure chamber being defined between the first face of each piston portion and its corresponding housing, each said first face of each valve member piston portion being subjected to fluid pressure in its corresponding pressure chamber to urge the valve member towards its first position, and each said second face being subjected to the pressure in the inlet passage to urge the valve member towards its second position, each said first face having an effective surface area larger than the effective surface area of its corresponding second face whereby to produce a resultant force urging each valve member towards its first position when pressures on the first and second face of each piston portion are equal, each pressure chamber having a bleed valve for bleeding fluid therefrom, each bleed valve having an operating member operable to open the bleed valve to relieve the pressure in its associated pressure chamber and allow its associated valve member to be moved to its second position by fluid pressure exerted on its said second force, the valve member of said first valve having a passage extending through its piston portion and placing its associated pressure chamber in communication with its inlet passage, the control unit further comprising a valve-connecting passage for placing the jack-supply passage of the first valve in communication with the pressure chamber of the second valve.

2. A control device as claimed in claim 1, in which the said housing of the first valve and the said housing of the second valve comprise a single casing common to both valves in which the valve members are disposed side-by-side, the said valve-connecting passage for placing the jack-supply passage of the first valve in communication with the pressure chamber of the second valve extending through a portion of the casing disposed between the valve members.

3. A control device as claimed in claim 1, and further comprising a non-return valve in the valve-connecting passage for preventing fluid flow from the pressure chamber of the second valve to the jack-supply passage of the first valve.

4. A control device as claimed in claim 1, in which the inlet passages of the valves are separate from one another.

5. A control device as claimed in claim 1, and further comprising a valve spindle, the passage through the piston portion of the valve member of the first valve including a bore, said valve spindle being disposed with one end region thereof in said bore and slidable therein with a radial (i.e. lateral) clearance, and the other end region of the spindle abutting the valve housing of the first valve, the arrangement being such that during movement of the valve member of the first valve from its first position to its second position the spindle slides further into the bore so as to eject from the bore the majority of fluid therein, which ejected fluid (which may entrain dirt particles) flows towards the jack-supply passage.

6. A control device as claimed in claim 1, and further comprising a pressure-communicating passage arranged to communicate pressure in the jack-supply passage of the second valve to the pressure chamber of the second valve.

7. A control device as claimed in claim 6, and further comprising a pressure limiting valve biased to close said pressure-communicating passage, and arranged to open when an adjustable set pressure is reached in the jack-supply passage of the second valve.

8. A control device as claimed in claim 7, in which the pressure limiting valve comprises a ball arranged to close the pressure-communicating passage, a spring which biases said ball, and adjustment means serving to adjust the force with which the spring biases the ball.

9. A control device as claimed in claim 6, in which a pressure indicator is provided for monitoring pressure of the fluid in the jack-supply passage of the second valve.

10. In combination: a control device as claimed in claim 1; sources of pressurised hydraulic fluid connected one to each valve inlet passage; a fluid reservoir connected to the outlet passages of the valves; and a double acting jack comprising a cylinder, a piston movable in the cylinder, and two jack-supply lines connecting respective ends of the cylinder, with respective jack-supply passages of the first and second valves.

* * * * *